US005562514A

United States Patent [19]

Rowe

[11] Patent Number: 5,562,514

[45] Date of Patent: Oct. 8, 1996

[54] INDIVIDUAL FLOTATION DEVICE

[76] Inventor: Thomas Rowe, 4740 W. Avenida Del Rey, Glendale, Ariz. 85310

[21] Appl. No.: 602,356

[22] Filed: Feb. 16, 1996

[51] Int. Cl.[6] ..... B03C 9/08

[52] U.S. Cl. ..... 441/130; 441/129

[58] Field of Search ..... 441/80, 88, 106–123, 441/125, 129–132, 136, 35, 43; 472/129; 482/111

[56] References Cited

U.S. PATENT DOCUMENTS

| | | | |
|---|---|---|---|
| 785,503 | 3/1905 | Krieger | 441/114 |
| 2,974,331 | 3/1961 | Dize . | |
| 4,580,988 | 4/1986 | Correll | 441/130 |
| 4,861,300 | 8/1989 | Casagrande . | |
| 5,090,695 | 2/1992 | Ciolino | 441/129 |
| 5,324,221 | 6/1994 | Kaufman et al. | 441/129 |
| 5,406,653 | 4/1995 | Todor | 441/130 |

FOREIGN PATENT DOCUMENTS

| | | | |
|---|---|---|---|
| 3539528 | 3/1987 | Germany | 441/122 |

*Primary Examiner*—Edwin L. Swinehart
*Attorney, Agent, or Firm*—LaValle D. Ptak

[57] ABSTRACT

A flotation device designed to support a person in a partially submerged position in a body of water includes a long narrow flexible main body member made of buoyant closed cell foam material. A first cylindrical float section, made of the same material, is attached to one end of the main body member. A second cylindrical section, also made of the same buoyant material, has a slot in it and slides over the second end of the main body member to frictionally engage the main body member to locate the second float section at various positions between the first and second ends of the main body member.

19 Claims, 1 Drawing Sheet

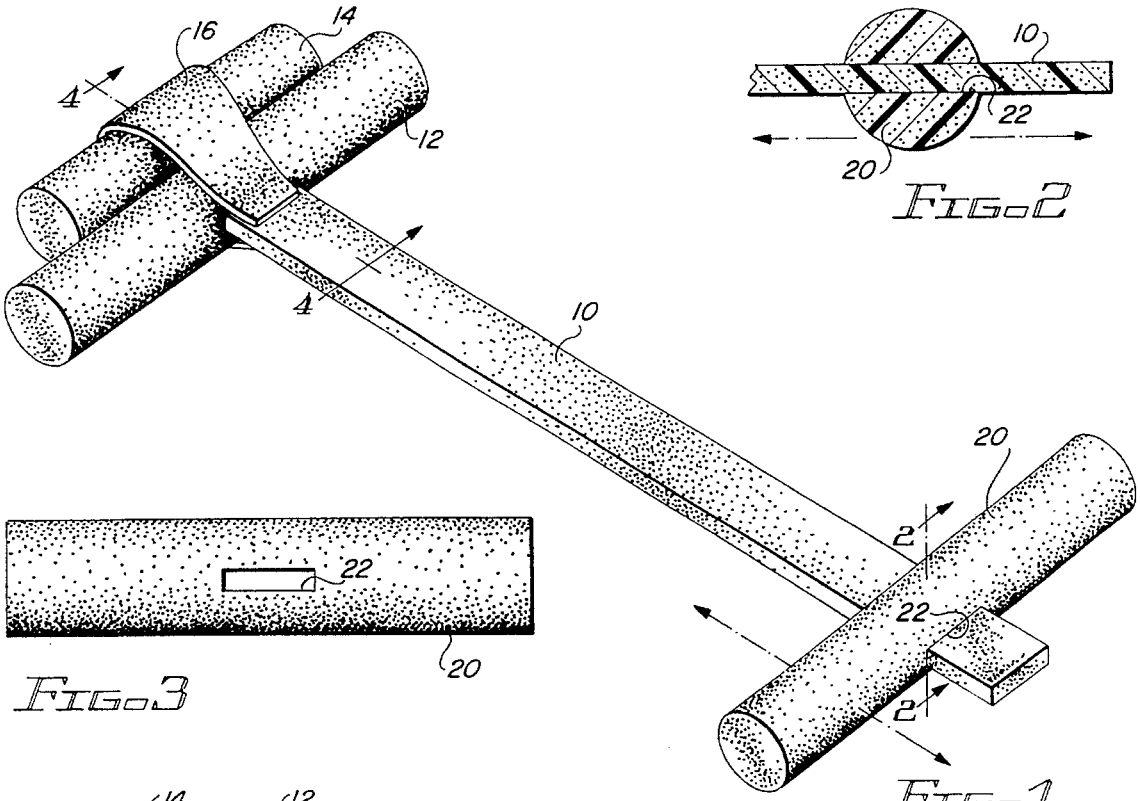
FIG. 1
FIG. 2
FIG. 3
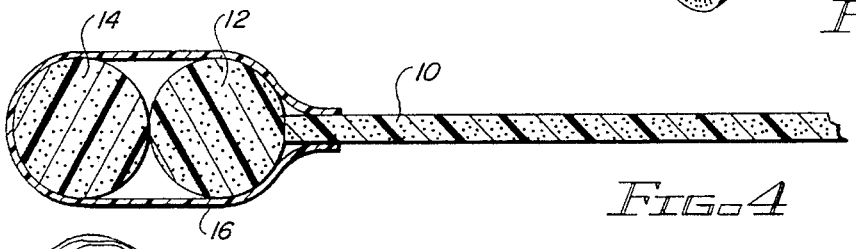
FIG. 4
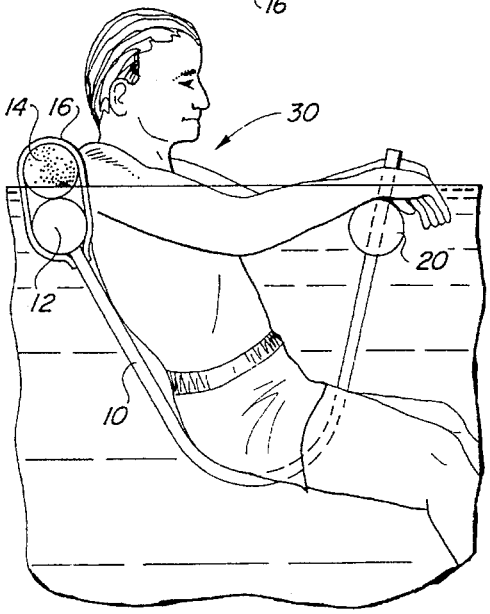
FIG. 5
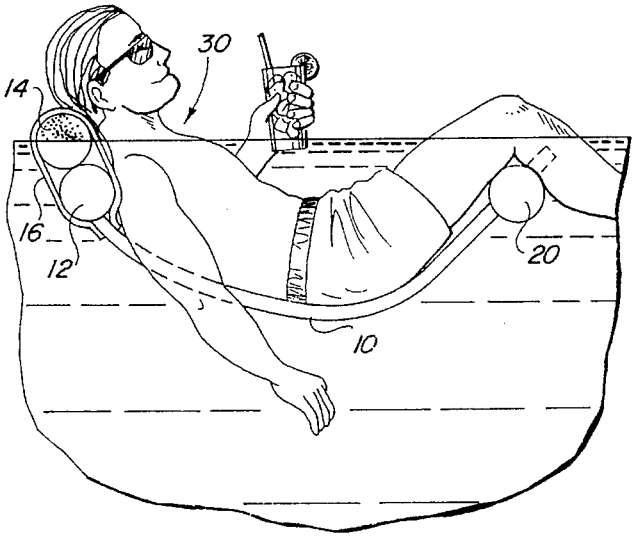
FIG. 6

INDIVIDUAL FLOTATION DEVICE

BACKGROUND

Flotation devices for use both as recreational floats and for physical therapy exist in a wide number of forms. A popular float is an inflatable raft, which supports the body of a person above the water when a person reclines, either face up or face down, on the raft. Inner tubes and flotation rings, as well as flotation belts and life vests made of closed cell foam materials and inflatable materials, are well known.

In an effort to provide a flotation device which supports a body in a submerged or semi-submerged position, the device shown in the U.S. patent to Correll U.S. Pat. No. 4,580,988 has been developed. The Correll device is designed for physical therapy, and in one embodiment consists of a three-piece float with a rigid seat portion and two upstanding portions designed to be located on opposite sides of the body. The upstanding portions are vertically adjustable to allow them to be used with persons of different physical characteristics. Depending upon the relative angular orientation of the upright portions to the seat portion, the device may be used in a sitting position under water, or for a non-sitting or back float position, with the major portion of the body of the person using the device located under the water. In a different variation, a flexible strap is used to interconnect two transverse float members; so that when the legs of the user straddle opposite sides of the strap, one of the float members presses against the back of the user and the other against the chest. This permits a person to float in a sitting position. The rigid seat of the first embodiment is made of wood or buoyant plastic material; and the arms at the end of the hinged extension on each end of the seat are filled with a buoyant substance. Neither of the embodiments of the Correll patent, however, provide a flexible buoyant portion to underlie the back of a user in a float position.

A float designed for use as a back float aid is described in the U.S. patent to Kaufman U.S. Pat. No. 5,324,221. The float of Kaufman consists of three sections, one for the head, one for the back and one for the buttocks of the user. No support for the legs is employed. The three floating sections are connected by hinges; and the section between the upper back and the buttocks portion has an adjustable length hinge to permit use by persons of different heights. This float employs wide flat sections, as opposed to narrow sections, for the various float members.

A variation of the Kaufman device is disclosed in the U.S. patent to Todor U.S. Pat. No. 5,406,653. In Todor, three shiftable air support sections are employed; and these sections are adjustable along a pair of elongated flexible plastic tubes. One of the supports is designed to underlie the head, a second is designed to underlie the lower back, and the third support is designed to underlie the thighs of the user (extending to the knees). Wide supports are used for all three of the different parts of this device; and it is not designed for use in the sitting position where the legs straddle a portion of the device.

The U.S. patent to Ciolino U.S. Pat. No. 5,090,695 discloses an exercise float which has three sections joined together by hinges. Each of the sections is relatively wide and has hollow compartments in it for holding float cushions to adjust the float support provided by the float device. The float of Ciolino is also not designed to be straddled by the user for employment in an underwater sitting position, and it is of relatively complex construction.

It is desirable to provide a float device for use by an individual which is of simple construction, which is adjustable for use by persons with different physical characteristics, and for different purposes by the same person, and which overcomes the disadvantages of the prior art devices noted above.

SUMMARY OF THE INVENTION

It is an object of this invention to provide an improved flotation device.

It is another object of this invention to provide an improved adjustable flotation device.

It is an additional object of this invention to provide an improved individual adjustable flotation device.

It is a further object of this invention to provide an individual adjustable flotation device made of closed cell foam material for recreational use and physical therapy.

In a preferred embodiment of the invention, an elongated main body member made of flexible buoyant material has a length which is substantially greater than its width. A first float section is attached to one end of the main body member; and a second float section is movably attached to the main body member for location along the length thereof to various positions between the ends of the main body member.

BRIEF DESCRIPTION OF THE DRAWINGS

FIG. 1 is a top perspective view of a preferred embodiment of the invention;

FIG. 2 is a cross-sectional view taken along the line 2—2 of FIG. 1;

FIG. 3 is an end view of a portion of the device shown in FIG. 1;

FIG. 4 is a cross-sectional view taken along the line 4—4 of FIG. 1;

FIG. 5 illustrates the device of FIG. 1 in one mode of use; and

FIG. 6 illustrates the device of FIG. 1 in a second mode of operation.

DETAILED DESCRIPTION

Reference now should be made to the drawing, in which the same reference numbers are used throughout the different figures to designate the same components. FIG. 1 is a top perspective view of a preferred embodiment of the invention. A flotation device for use by an individual comprises a first elongated main body member 10 made of a flexible, buoyant flotation material, preferably a closed cell foam material. The elongated body member 10 typically has a length which is three feet to four feet, with a width of 4 inches to 8 inches and a thickness on the order of 1 or 2 inches. The material selected for the member 10 is flexible throughout its length; so that it readily adjusts to and conforms against the body of a person using the float.

At the upper left-hand end of the flotation device shown in FIG. 1, a pair of transverse cylindrical flotation sections 12 and 14 are attached by means of a relatively thin strap of flexible plastic material 16 to the end of the elongated body member 10. As shown most clearly in FIG. 4, the strap 16 wraps tightly around the cylindrical flotation devices 12 and 14 and is secured to the end of the main body member 10 on opposite sides by heat welding or other suitable adhesive. The strap 16 also may be removably attached by means of a hook and loop fastener, such as VELCRO®, or the like, if desired. For most applications, however, a permanent attachment of the cylinders 12 and 14 is preferred. The cylinders 12 and 14 also are made of buoyant material, preferably of the same closed cell foam which constitutes the elongated body member 10, and preferably are between one and two feet in length.

At the opposite end of the body member 10, another transverse cylindrical buoyant flotation section 20 is used. The section 20 has a rectangular slot 22 cut through it to frictionally engage the main body member 10. It should be noted that the configuration of the slot 22 is substantially the same as the external cross sectional dimensions of the main body member 10; so that the float section 20 may be moved back-and-forth in the direction of the arrows shown in FIG. 1 along the length of the body member 10. This permits the float section 20 to be located anywhere along the length of the body member 10 desired for the particular use intended for the float member. Adjustment of the float section 20 also may be made to accommodate persons having different physical characteristics. The float section 20 is between one and two feet in length, and also is made of the same buoyant material which is used for the members 10, 12 and 14.

Reference now should be made to FIGS. 5 and 6, which illustrate different positions of use of the flotation device shown in FIG. 1. In both of these positions, the device may be used for stress therapy, physical therapy, aquatic games or simply as a recreational float. When closed cell foam material with the dimensions described above is used, the device is capable of supporting adults and children in a semi-submerged position in a body of water.

When the user straddles the member 10, as shown in FIG. 5, with the member 10 extending between the legs of the user on one side and extending along the center of the back of the user on the other side, the body is in a generally upright (but relaxed) position. Adjustment of the position of the float section 20 along the length of the member 10, as shown in FIG. 5, allows the user to extend the hands or elbows over the member 20 to rest them on it. On the other end, the float sections 14 and 16 are located just behind the shoulders of the person 30 using the device. In this position, the head and shoulders are supported by the float section 12 and 14; and the hands, arms and legs are free for complete movement for propulsion, exercise or therapy. The body of the person 30 is stabilized by the flotation device, as illustrated. When the person 30 leans forward to a more upright position, a nearly vertical orientation may be achieved. By leaning back, the person can attain the position shown in FIG. 5, or any position in between.

When used as illustrated in FIG. 6, the flotation device is adjusted to position the second float section 20 beneath the knees of the user 30. This is the reclined position of the device. The majority of the body of the person 30 is submerged in a reclined semi-seated position; and the device provides a totally relaxed "floating" sensation for the user. The head and shoulders rest on the float sections 12/14 and the flexible main body member 10 underlies the entire back, buttocks and thigh area of the user 20, with sufficient backside buoyancy to support the body in the position shown in FIG. 6.

Although the use of closed cell foam material of the type widely used in water ski belts and life jackets is considered to be the preferred material for all of the various parts 10, 12, 14 and 20 of the flotation device, other materials may be used. For example, the float section members 12, 14 and 20 may be made of STYROFOAM® or other material if desired. Whatever material is used for the float section 20, however, it must be capable of movement along the length of the main body member 10. Ideally, the positioning of the section 20 on the main body member 10 should be effected by a tight frictional fit, since this is the simplest construction. It should be noted, however, that mechanical latching of some type also may be used, if desired, and if necessary because of the selection of particular materials.

The foregoing description of the preferred embodiment of the invention is to be considered as illustrative and not as limiting. Various changes and modifications will occur to those skilled in the art for performing substantially the same function, in substantially the same way, to achieve substantially the same result without departing from the true scope of the invention as defined in the appended claims.

What is claimed is:

1. A flotation device for supporting a person in a reclining or sitting position in a body of water including in combination:

a flexible elongated main body member of a predetermined thickness selected to underlie the back of a person, said main body member having a length several times greater than the width thereof, made of buoyant material, and having first and second ends;

a first transverse float section attached to the first end of said main body member to underlie the neck and head of a person; and a second transverse float section movably attached to said main body member between the first and second ends thereof for location at various positions along the length thereof.

2. The combination according to claim 1 wherein said second float section is an elongated member having a slot therein with height and width corresponding to the thickness and width of said elongated main body member for frictional engagement with said main body member to permit relative movement of said main body member through said slot to position said second float section at selected positions along the length of said main body member.

3. The combination according to claim 2 wherein said first and second float sections are cylindrical members.

4. The combination according to claim 3 wherein said first and second float sections are made of the same buoyant material of which said elongated main body member is made.

5. The combination according to claim 4 wherein said main body member has a length of between three feet and four feet and a width between four inches and eight inches.

6. The combination according to claim 5 wherein said buoyant material is closed cell foam material.

7. The combination according to claim 6 wherein said first and second float sections each have a length less than the length of said elongated main body member and each of said float sections are attached to said main body member at substantially the midpoint of each of said float sections.

8. The combination according to claim 1 wherein said elongated main body member is made of closed cell foam material.

9. The combination according to claim 8 wherein said first and second float sections are made of closed cell foam material.

10. The combination according to claim 1 wherein said float sections are cylindrical float sections.

11. The combination according to claim 1 wherein said first float section includes at least one elongated member attached transversely to said first end of said elongated main body member.

12. The combination according to claim 11 wherein said float sections are cylindrical float sections.

13. The combination according to claim 12 wherein said first and second float sections are made of the same buoyant material of which said elongated main body member is made.

14. The combination according to claim 13 wherein said second float section is an elongated member having a slot therein with height and width corresponding to the thickness and width of said elongated main body member for frictional engagement with said main body member to permit relative movement of said main body member through said slot to position said second float section at selected positions along the length of said main body member.

15. The combination according to claim 1 wherein said first and second float sections each have a length less than the length of said elongated main body member and each of said float sections are attached to said main body member at substantially the midpoint of each of said float sections.

16. The combination according to claim 1 wherein said main body member has a length of between three feet and four feet and a width between four inches and eight inches.

17. The combination according to claim 16 wherein said first and second float sections each have a length less than the length of said elongated main body member and each of said float sections are attached to said main body member at substantially the midpoint of each of said float sections.

18. The combination according to claim 17 wherein said first and second float sections are made of the same buoyant material of which said elongated main body member is made.

19. The combination according to claim 18 wherein said buoyant material is closed cell foam material.

* * * * *